US007073570B2

(12) United States Patent
Yu et al.

(10) Patent No.: US 7,073,570 B2
(45) Date of Patent: Jul. 11, 2006

(54) AUTOMOTIVE HEAT EXCHANGER

(75) Inventors: Wen Fei Yu, Ann Arbor, MI (US); Loren Lohmeyer, III, Monroe, MI (US); Manos Eliades, Belleville, MI (US); Jack H. Riddle, II, Brighton, MI (US)

(73) Assignee: Visteon Global Technologies, Inc., Van Buren Township, MI (US)

( * ) Notice: Subject to any disclaimer, the term of this patent is extended or adjusted under 35 U.S.C. 154(b) by 233 days.

(21) Appl. No.: 10/667,627

(22) Filed: Sep. 22, 2003

(65) Prior Publication Data

US 2005/0061488 A1 Mar. 24, 2005

(51) Int. Cl.
*F28F 1/42* (2006.01)

(52) U.S. Cl. ..... 165/140; 165/179; 165/916

(58) Field of Classification Search ..... 165/140, 165/916, 177, 179, 172–174, 109.1
See application file for complete search history.

(56) References Cited

U.S. PATENT DOCUMENTS

| | | | | |
|---|---|---|---|---|
| 2,151,540 | A * | 3/1939 | Varga | 165/179 |
| 3,596,495 | A * | 8/1971 | Huggins | 72/370.18 |
| 5,123,483 | A | 6/1992 | Tokutake et al. | |
| 5,323,851 | A | 6/1994 | Abraham | |
| 5,372,188 | A * | 12/1994 | Dudley et al. | 165/179 |
| 5,476,141 | A | 12/1995 | Tanaka | |
| 5,533,259 | A | 7/1996 | Hughes et al. | |
| 6,016,864 | A * | 1/2000 | Bae et al. | 165/177 |
| 6,062,303 | A * | 5/2000 | Ahn et al. | 165/174 |
| 6,073,686 | A | 6/2000 | Park et al. | |
| 6,119,340 | A | 9/2000 | Insalaco et al. | |
| 6,209,202 | B1 | 4/2001 | Rhodes et al. | |
| 6,213,158 | B1 | 4/2001 | Rhodes et al. | |
| 6,241,012 | B1 * | 6/2001 | Yu et al. | 165/177 |
| 6,289,980 | B1 | 9/2001 | Insalaco et al. | |
| 6,394,176 | B1 | 5/2002 | Marsais | |
| 2003/0209344 | A1 | 11/2003 | Fang et al. | |
| 2004/0216863 | A1 * | 11/2004 | Hu | 165/140 |
| 2004/0261983 | A1 * | 12/2004 | Hu | 165/148 |
| 2005/0006068 | A1 * | 1/2005 | Desai et al. | 165/140 |

FOREIGN PATENT DOCUMENTS

| | | |
|---|---|---|
| DE | 195 36 116 A1 | 4/1997 |
| GB | 944723 | 12/1963 |

* cited by examiner

*Primary Examiner*—Teresa J. Walberg
(74) *Attorney, Agent, or Firm*—Brinks Hofer Gilson & Lione

(57) ABSTRACT

A heat exchanger includes a first section and a second section for cooling distinct fluids, wherein the second section is adapted for cooling oil. The heat exchanger includes first and second manifolds divided by baffles into first and second chambers. A plurality of tubes connect the manifolds in fluid communication with the first chambers to form the first section of the heat exchanger. A plurality of oil cooling tubes connect the manifolds in fluid communication with the second chambers to form the second section. The oil cooling tubes have a cross-section characterized by a performance ratio between about 3.9 and 8.5 wherein the performance ratio is the ratio of the wetted perimeter in millimeters divided by the cross-sectional area of tube metal in square millimeters. The oil cooling tubes may be formed of extruded metal with internal fins or an extruded tube having a stamped metal insert.

9 Claims, 3 Drawing Sheets

AUTOMOTIVE HEAT EXCHANGER

TECHNICAL FIELD OF THE INVENTION

This invention relates to a heat exchanger that includes an oil cooler section, and, more particularly, to an oil cooler section that includes tubes having an improved performance ratio.

BACKGROUND OF THE INVENTION

An automotive vehicle comprises one or more heat exchangers for cooling fluids used in the vehicle systems, such as refrigerant for an air conditioning system or transmission oil for a transmission device. A common heat exchanger comprises a plurality of parallel tubes connected at each end to a manifold and spaced apart by corrugated fins. Typically the tubes are formed of extruded aluminum. The manifolds include an inlet for receiving the fluid to be cooled and an outlet for supplying cooled fluid to other components in the system. The fluid enters the manifold through the inlet and is distributed to flow through passages within the tubes. Heat is extracted by air that flows through spaces between the corrugated fins between the tubes. The manifolds may include baffles that divide the manifold into sections and route the fluid back and forth in multiple passes.

It is known to manufacture a heat exchanger that is divided into separate sections for cooling different fluids. For example, heat exchangers are available that include a condenser section for cooling refrigerant and an oil cooler section for cooling transmission oil. The manifolds are divided by baffles to segregate the fluids. To facilitate manufacture, the tubes for both sections have the same outer dimensions. Because of the relatively high pressure of the refrigerant within the condenser section, the tubes include multiple internal webs to strengthen the outer walls and prevent distortion. The webs divide the cross section of the tubes into discrete regions of relatively small area. Because the refrigerant enters the heat exchanger as a gas, such small regions are effective in cooling and condensing the refrigerant. On the other hand, the transmission oil flowing through the oil cooler section is a liquid having a relatively low pressure and a relatively high viscosity. Small cross sectional paths, such as found in condenser tubes, result in a relatively high pressure drop for the oil. However, elimination of the webs to increase the size of the flow paths reduces contact between the oil and the tubes. This reduces cooling efficiency and necessitates an increase in either the length or number of tubes to achieve the desired temperature drop.

Therefore, a need exists for the heat exchanger having an oil cooler section that includes tubes extending between manifolds and sized and shaped to enhance the cooling efficiency for oil flowing therethrough, thereby reducing the length or number of tubes, and thus the size of the heat exchanger.

SUMMARY OF THE INVENTION

This invention provides a heat exchanger for an automotive vehicle that includes an oil cooler section, preferably in combination with a separate section for cooling a different fluid, such as a condenser section for an air conditioning system. The heat exchanger includes a first manifold and a second manifold that are spaced apart, and a plurality of tubes that extend between the manifolds and define fluid passages in fluid communication with chambers within the manifolds. At least a portion of the tubes define oil flow passages for the oil cooler section and are adapted for conveying oil. In accordance with this invention, the oil cooling tubes have a cross section characterized by a performance ratio between about 3.9 and 8.5. As used herein, the performance ratio is based upon a cross-section of the tube and refers to the ratio of the wetted perimeter of the oil flow passage in millimeters divided by the cross sectional area of the metal of the tube, that is, excluding the area of the oil flow passage. By utilizing tubes having a performance ratio within the recited range, the heat exchanger improves the cooling efficiency for oil and thereby reduces the length or number of tubes required to achieve a desired cooling effect.

BRIEF DESCRIPTION OF THE DRAWINGS

This invention will be further described with reference to the accompanying drawings wherein.

DETAILED DESCRIPTION OF THE INVENTION

Figure 1:
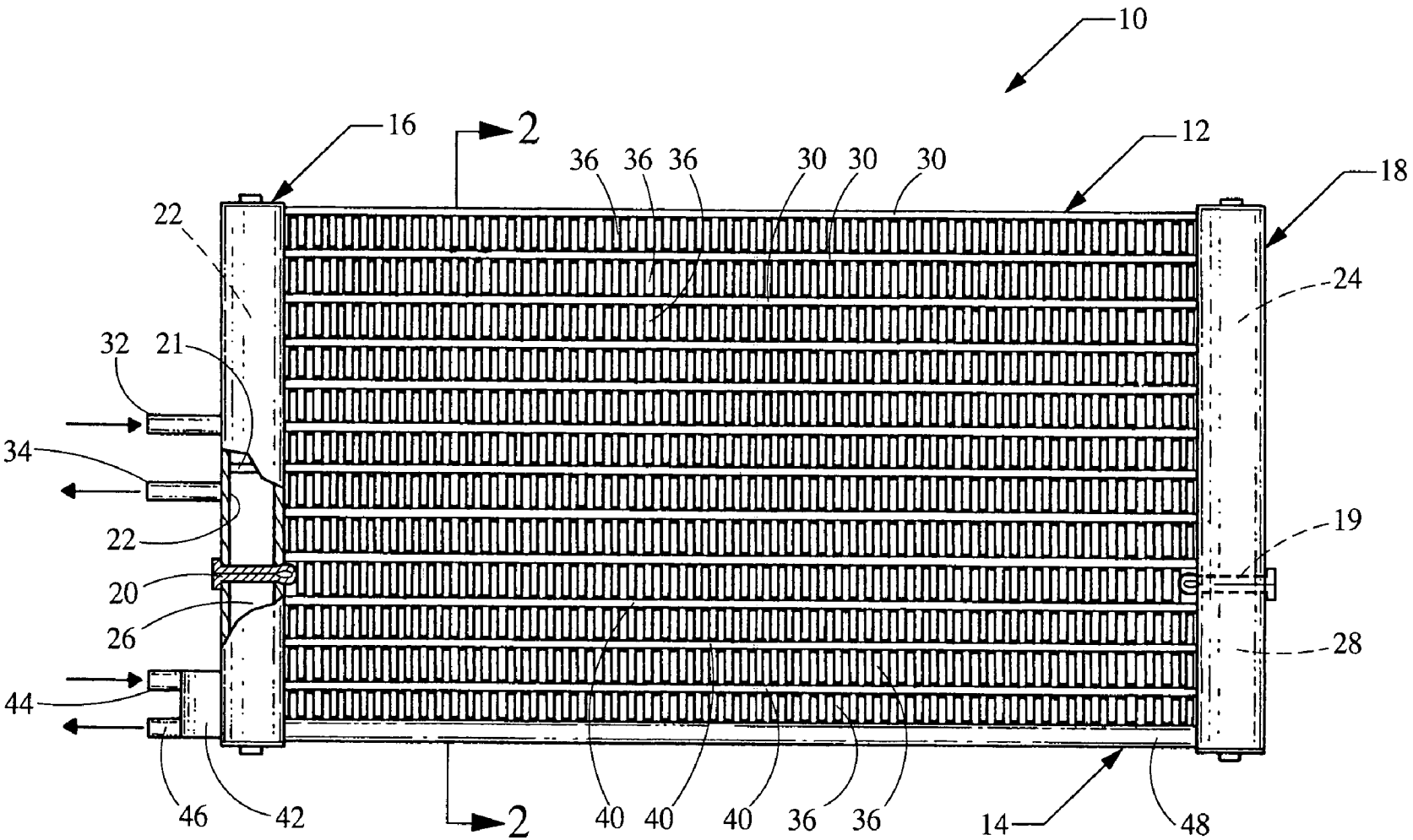
FIG. 1 is a plan view, partially cutaway, showing a combination heat exchanger in accordance with a first preferred embodiment of this invention.
Figure 2:
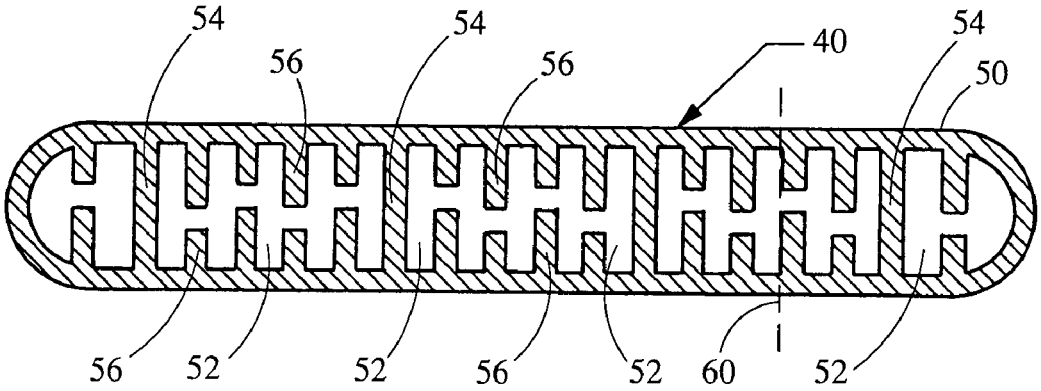
FIG. 2 is a cross sectional view of an oil cooling tube in FIG. 1, taken along line 2—2 in the direction of the arrows.

In accordance with a first preferred embodiment of this invention, referring to FIGS. 1 and 2, a combination heat exchanger 10 is adapted for use in an automotive vehicle and includes a first section 12 and a second section 14 for cooling different fluids. In a preferred embodiment, section 12 is a condenser for cooling refrigerant for an air conditioning system. Also in a preferred embodiment, section 14 is adapted for cooling transmission oil, and is referred to herein as a transmission oil cooler section. Alternately, heat exchanger 10 may be adapted for cooling other fluids.

Heat exchanger 10 comprises a first manifold 16 and a second manifold 18 in spaced, parallel relationship. Baffles 19 and 20 divide each manifold 16 and 18 into first chambers 22 and 24 for condenser section 12 and second chambers 26 and 28 for oil cooling section 14. In addition, the manifolds may include baffles, for example, baffle 21 that further divide the chambers into portions for routing the fluids through the section along a particular flow path. Referring to condenser section 12, the section further includes a plurality of tubes 30 that extend between manifolds 16 and 18 and define flow passages in fluid communication with chambers 22 and 24. Condenser section 12 further comprises an inlet 32 and an outlet 34. During operation in an automotive air conditioning system, inlet 32 is coupled to a compressor for receiving warm refrigerant therefrom, and outlet 34 is coupled to an evaporator for discharging cooled refrigerant thereto. Within the condenser section 12, the refrigerant is distributed through chambers 26 and 28 to flow through the flow paths within tubes 30, whereupon the refrigerant is cooled as a result of heat extracted by air flowing within the spaces between the tubes. Fins 36 disposed within the spaces between the tubes further enhances heat transfer from the fluid to the air.

Referring now to oil coolant section 14, the section includes a plurality of tubes 40 that extend between manifolds 16 and 18 and include flow passages in fluid communication with chambers 26 and 28. The tubes are in spaced, parallel arrangement. Fins 36 are disposed between the tubes to enhance heat transfer with cooling air caused to flow through the space between the tubes. A connection block 42 includes an inlet 44 and an outlet 46. During operation, inlet 44 is coupled to a transmission case for receiving warm transmission oil therefrom, and directs the oil into chamber 26. The oil flows from chamber 26 through the oil passages within tubes 40, whereupon the oil is cooled by air flowing through the spaces between the tubes. The oil flows from the tubes into chamber 28 and is returned through an oil return tube 48 to connection block 42 for discharge through outlet 46, which is coupled to return the cooled oil to the transmission case. Return tube 48 is sized considerably larger than the oil flow passages in tubes 40 and provides additional strength to heat exchanger 10.

Referring now to FIG. 2, there is shown a cross section of an oil cooling tube 40 in accordance with a first embodiment of this invention. Tube 40 is an extruded tube formed of metal, preferably aluminum. Tube 40 comprises an outer wall 50 surrounding an oil flow passage 52 that is divided by webs 54 into distinct flow paths. As used herein, oil flow passage refers to the volume within the tube for transporting fluid, which, in this example is the total of the several flow paths separated by webs 54. It is pointed out that webs 54 strengthen outer wall 50 to prevent damage to the tube during handling or distortion due to fluid pressure during use. Tube 40 further comprises fins 56 that extend from outer wall 50 into the oil flow passage 52. Fins 56, which are also referred to as enhancements, increase the surface area of tube 40 in contact with fluid flowing through oil flow passage 52. Webs 54 and fins 56 extend along an axis 60 perpendicular to the direction of fluid flow through passage 52. In contrast to webs 54 that divide passage 50 into discrete flow paths, fins 56 are spaced apart by a gap to allow fluid communication between adjacent portions of the flow path. The fins increase surface contact between the tube and the fluid to thereby enhance heat transfer therebetween. Moreover, the gaps promote fluid flow about the fins and reduce flow resistance, thereby reducing the pressure drop caused by fluid flow through the oil flow passage. In FIG. 2, the gaps are staggered across the cross-section such that each gap is offset relative to adjacent gaps. Alternately, the gaps may be aligned.

In accordance with this invention, cooling efficiency is improved in a heat exchanger that includes an oil cooler section having tubes with a performance ratio between about 3.9 and 8.5. For the purpose of determining the performance ratio, the cross section of tube 40 is characterized by a wetted perimeter representing the inner surface of the tube in contact with fluid flowing through the oil flow passage, determined in millimeters. Preferably, the wetted perimeter is greater than about 100 millimeters. The tube cross section is also characterized by a cross sectional area, in square millimeters, of the tube metal, not including the flow passage. The performance ratio is calculated as the ratio of the wetted perimeter divided by the cross sectional area. Referring to Table 1, there is reported performance ratios for examples of oil cooling tubes in accordance with this invention. Examples 1 through 8 comprise extruded aluminum tubes similar to FIG. 2 with varying numbers of webs and fins. For purposes of comparison, the Comparison Examples 1 is extruded aluminum tubes featuring multiple webs that divide the interior into generally rectangular fluid channels, such as are commonly employed for a condenser and would suitably be employed in condenser section 12. As reported in Table 1, Examples 1 through 8 exhibit performance ratios within the range of 3.9 to 8.5. In contrast, the condenser tubes in the Comparison Examples exhibits a performance ratio significantly below 3.0.

TABLE 1

| Tube Type | Tube Size | Webs | Web Thickness (mm) | Fins | Fin Thickness (mm) | Wall Thickness (mm) | Wetted Perimeter (mm) | Tube Cross Section ($mm^{-2}$ | Performance Ratio ($mm^{-1}$) |
|---|---|---|---|---|---|---|---|---|---|
| Example 1 | 3 × 16 | 4 | 0.3 | 17 | 0.3 | 0.31 | 117.3 | 23.6 | 4.96 |
| Example 2 | 3 × 16 | 3 | 0.3 | 16 | 0.3 | 0.31 | 108.4 | 22.2 | 4.88 |
| Example 3 | 4 × 16 | 4 | 0.3 | 17 | 0.3 | 0.31 | 168.1 | 32.7 | 5.14 |
| Example 4 | 4 × 16 | 3 | 0.3 | 16 | 0.3 | 0.31 | 154.7 | 30.6 | 5.05 |
| Example 5 | 6 × 16 | 4 | 0.2 | 20 | 0.2 | 0.2 | 287.1 | 34.1 | 8.43 |
| Example 6 | 6 × 16 | 3 | 0.2 | 18 | 0.2 | 0.2 | 253.3 | 30.6 | 8.27 |
| Example 7 | 3 × 16 | 4 | 0.35 | 14 | 0.35 | 0.35 | 101.8 | 25.9 | 3.94 |
| Example 8 | 3 × 16 | 3 | 0.35 | 14 | 0.35 | 0.35 | 97.1 | 24.9 | 3.90 |
| Comparison Example | 3 × 16 | 5 | 0.4 | 0 | — | 0.4 | 50.8 | 18.7 | 2.72 |
| Example 9 | 3.6 × 16 | — | — | — | — | 0.31 | 108.5 | 16.4 | 6.64 |

While not limited to any particular theory, it is believed that oil cooling tubes having performance ratios in accordance with this invention provide optimum cooling for transmission oil and like fluids that are characterized by relatively low pressure and relatively high viscosity. The high surface contact between the tube and the oil increases heat transfer from the oil to the tube and thereby promotes cooling of the oil. The relatively low mass of the tube metal increases heat transfer to the ambient air flowing thereabout and thus further enhances cooling of the oil. This is accomplished while maintaining a relatively large cross sectional area for the flow path to thereby minimize the pressure drop of oil flowing through the passages.

Figure 3:
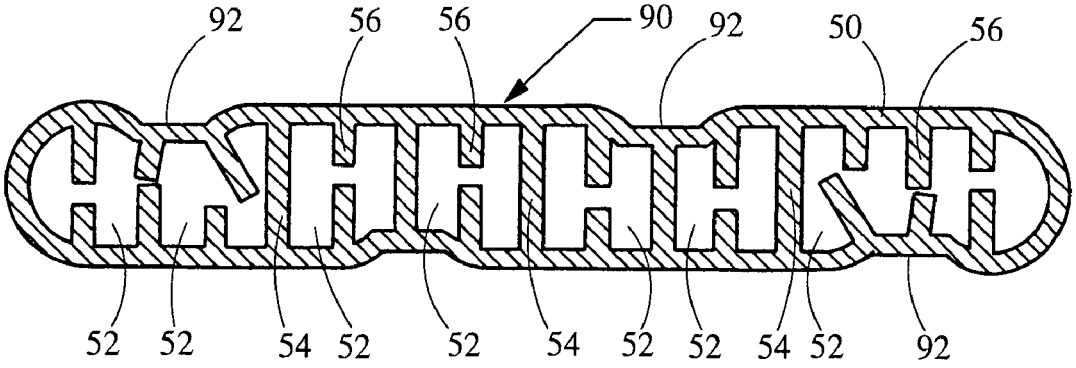
FIG. 3 is a cross sectional view of an oil cooling tube in accordance with an alternate embodiment of this invention.

In the embodiment in FIG. 1, fluid flow through passage 52 tends to be laminar. Cooling efficiency is further promoted by turbulent flow of the fluid. Referring now to FIG. 3, there is depicted an oil cooling tube for use in a heat exchanger in accordance with an alternate embodiment of this invention to increase turbulent flow and further enhance fluid cooling. Heat exchanger 90 is formed of an extruded metal tube and is similar to oil cooling tube 40 in FIG. 1, with like numerals being employed to indicate like elements. In addition, oil cooling tube 90 includes dimples 92 formed in outer wall 50. Dimples 92 deform the orientation of fins 56 within oil flow passages 52. This results in increased turbulence within oil flowing through the oil flow passage, which promotes mixing of the fluid and improves heat transfer between the oil and outer wall 50. It is believed that the dimples have minimal effect upon the performance ratio as calculated for the tube prior to dimpling.

Figure 4:
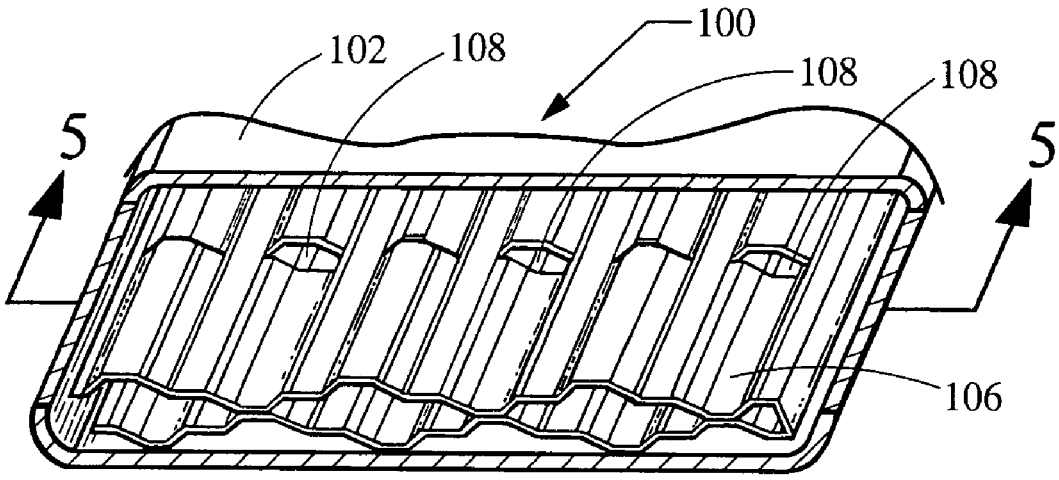
FIG. 4 is a perspective view, partially cut away, showing an oil cooling tube in accordance with a still further embodiment of this invention.
Figure 5:
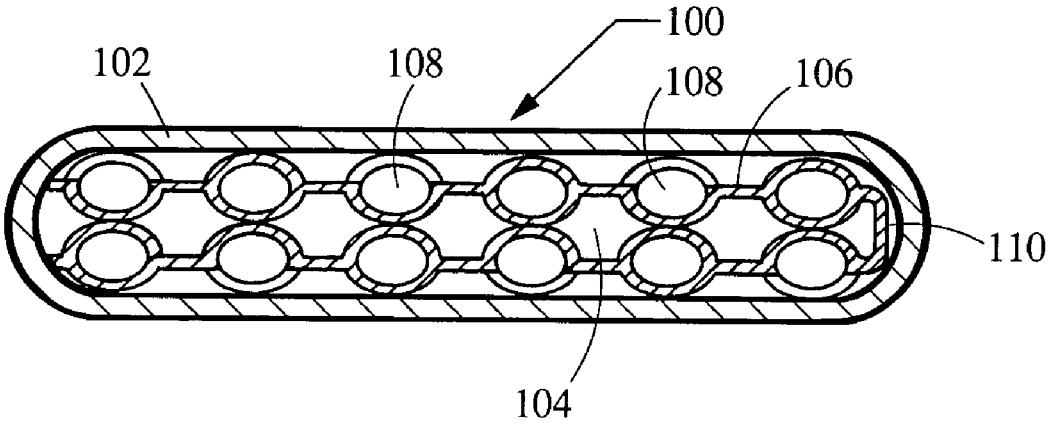
FIG. 5 is a cross sectional view of the tube in FIG. 4 taken along lines 5—5 in the direction of the arrows.

Referring now to FIGS. 4 and 5, there is depicted an oil cooling tube 100 in accordance with yet a further embodiment of this invention. Oil cooling tube 100 is adapted for use in a combination heat exchanger, similar to heat exchanger 10 in FIG. 1, in substitution of tubes 30. Tube 100 comprises an outer wall 102 formed of extruded metal, preferably aluminum metal and defines an oil flow passage 104 for conveying oil therethrough. In accordance with this embodiment, a turbulator 106 is inserted within tube 100. Turbulator 106 is formed of stamped metal and includes openings 108 to promote turbulent flow of oil through passage 104. Further details regarding the turbulator and the method for manufacturing same are described in U.S. Pat. No. 6,213,158, issued to Rhodes, et al., Apr. 10, 2001. In accordance with this aspect of this invention, turbulator 106 features a dual-layer structure formed of a single stamped metal sheet that is bent at 110. Referring to Table 1, Example 9 reports a performance ratio for a dual-layer turbulator in accordance with this embodiment. For purposes of comparison, a comparable structure comprising a single layer turbulator exhibits a performance ratio of about 3.2. Thus, the dual-layer turbulator increases surface contact with the oil and creates turbulent flow through the oil passage to improve cooling efficiency.

While this invention has been disclosed in terms of certain embodiments thereof, it is not intended to be so limited, but rather only to the extent set forth in the claims that follow.

The invention claimed is:

1. A heat exchanger comprising an oil cooler section, said oil cooler section comprising:

a first manifold and a second manifold in spaced relationship, and a plurality of tubes, each said tube defining an oil flow passage and having a first end connected to said first manifold with said oil flow passage in fluid communication therewith and a second end connected to said second manifold with said oil flow passage in fluid communication therewith, each said tube being formed of tube metal with an inner and outer wall and opposing pairs of fins extending from the inner wall at least pan way into said oil flow passage, said fins being spaced apart by cans and said cans being staggered across the tube wherein each par is offset relative to an adjacent gap, each said tube having a cross-section characterized by a performance ratio between about 3.9 and 8.5, wherein the performance ratio is a ratio of a wetted perimeter in millimeters divided by a cross-sectional area of the tube metal in square millimneters.

2. The heat exchanger of claim 1 wherein the extruded metal tube comprises webs that divide the oil flow passage into multiple discrete flow paths.

3. The heat exchanger of claim 1 wherein the wetted perimeter is greater than about 100 millimeters.

4. The heat exchanger of claim 1 wherein the outer wall comprises dimples.

5. The heat exchanger of claim 1 wherein the oil cooler section comprises fins interposed between adjacent tubes.

6. A heat exchanger comprising a first section and a second section for cooling distinct fluids, whereby the second section is adapted for cooling oil, said heat exchanger comprising:

a first manifold comprising a baffle dividing said first manifold into a first chamber and a second chamber;

a second manifold in spaced, parallel arrangement to said first manifold and comprising a baffle dividing said second manifold into a first chamber and a second chamber;

a plurality of tubes connecting the first manifold and the second manifold and defining flow passages in fluid communication with the first chambers, thereby forming said first section of the heat exchanger; and a plurality of oil cooling tubes connecting the first manifold and the second manifold and defining fluid passages in connection with the second chambers, thereby forming the second section of the heat exchanger, each said oil cooling tube being formed of tube metal with an inner and outer wall and a plurality of opposing pairs of fins extending from the inner wall at least part way nto said oil fluid passages, said fins being spaced apart by gaps and said gaps being staggered across the tube wherein each gap is offset relative to an adjacent gap and said oil cooling tube having a cross-section characterized by a performance ratio between about 3.9 and 8.5, wherein the performance ratio is a ratio of a wetted perimeter in millimeters divided by a cross-sectional area of the tube metal in square millimeters.

7. The heat exchanger of claim 6 wherein the first section is a condenser for cooling refrigerant of an air conditioning system.

8. The heat exchanger of claim 6 wherein the tube further comprises webs that divide the oil flow passage into discrete flow paths.

9. The heat exchanger of claim 6 wherein the wetted perimeter is greater than 100 millimeters.

* * * * *

UNITED STATES PATENT AND TRADEMARK OFFICE

CERTIFICATE OF CORRECTION

PATENT NO. : 7,073,570 B2
APPLICATION NO. : 10/667627
DATED : July 11, 2006
INVENTOR(S) : Wen Fei Yu et al.

It is certified that error appears in the above-identified patent and that said Letters Patent is hereby corrected as shown below:

Column 5, in claim 1, line 47, before "being staggered" delete "cans and said cans" and substitute --gaps and said gaps-- in its place.

Column 5, in claim 1, line 48, after "wherein each" delete "par" and substitute --gap-- in its place.

Column 6, in claim 6, line 34, before "said oil fluid" delete "nto" and substitute --into-- in its place.

Signed and Sealed this

Nineteenth Day of December, 2006

JON W. DUDAS
*Director of the United States Patent and Trademark Office*